United States Patent [19]

Haddock

[11] 4,143,920

[45] Mar. 13, 1979

[54] MINERAL CUTTING PICK INSERT SHAPE

[75] Inventor: John W. Haddock, Sheffield, England

[73] Assignee: Hall & Pickles Limited, Sheffield, England

[21] Appl. No.: 884,217

[22] Filed: Mar. 7, 1978

[30] Foreign Application Priority Data

Mar. 7, 1977 [GB] United Kingdom ..... 09576/77

[51] Int. Cl.[2] ..... E21C 35/18

[52] U.S. Cl. ..... 299/79; 175/410

[58] Field of Search ..... 299/79, 90, 91–93, 299/82–84, 89; 175/410

[56] References Cited

FOREIGN PATENT DOCUMENTS

| | | | |
|---|---|---|---|
| 381753 | 5/1973 | U.S.S.R. | 175/410 |
| 976538 | 11/1964 | United Kingdom | 299/79 |
| 1348488 | 6/1971 | United Kingdom | 299/79 |
| 1333401 | 10/1973 | United Kingdom | 299/91 |

*Primary Examiner*—Ernest R. Purser

*Attorney, Agent, or Firm*—Lowe, King, Price & Becker

[57] ABSTRACT

A mineral cutting pick of the type adapted to be traversed relative to a mineral face and having a leading cutting edge and an outer cutting edge incorporated in a hard metal insert mounted in a rebate formed by a pair of seating surfaces at the end of a pick body remote from a shank for use in securing in a socket of a chain or drum or the like, wherein at least one end of the leading cutting edge adjacent the outer cutting edge has negative rake with respect to the shank, and the leading cutting edge is defined by surfaces the angle between which increases from the position at which it will make foremost contact with the mineral face to the end of the leading cutting edge adjacent the outer cutting edge, whereby a sharper angle for the leading cutting edge is provided where it will attack the mineral face and a blunter angle is provided towards the end adjacent the outer cutting edge to afford greater strength as the insert decreases in transverse width towards the outer cutting edge.

10 Claims, 24 Drawing Figures

MINERAL CUTTING PICK INSERT SHAPE

This invention relates to mineral cutting picks of the type adapted to be traversed relative to a mineral face and having a leading cutting edge and an outer cutting edge incorporated in a hard metal insert mounted in a rebate formed by a pair of seating surfaces at the end of a pick body remote from a shank for use in securing in a socket of a chain or drum or the like.

The object of the invention is to improve the performance of the pick and reduce breakages.

According to the present invention, in a mineral cutting pick of the type referred to at least one end of the leading cutting edge adjacent the outer cutting edge has negative rake with respect to the shank, and the leading cutting edge is defined by surfaces the angle between which increases from the position at which it will make foremost contact with the mineral face to the end of the leading cutting edge adjacent the outer cutting edge.

Thus it is possible to provide a sharper angle for the leading cutting edge where it will attack the mineral face and a blunter angle towards the end adjacent the outer cutting edge (i.e., towards the tip or nose of the insert) to afford greater strength as the insert decreases in transverse width towards the outer cutting edge.

The leading cutting edge may be straight or convexly curved, or it may be angular, with an appropriately shaped pair of surfaces, or pairs of surfaces, defining the leading cutting edge; and the leading cutting edge may be a sharp edge, or it may be rounded, or it may be provided with a flat or flats of transverse width small in relation to the overall width of the insert.

The outer cutting edge is preferably defined by a pair of convexly curved surfaces, and the adjacent part of the pick body is preferably provided with surfaces merging with the surfaces defining the outer cutting edge.

The part of the pick body adjacent the leading cutting edge is preferably provided with surfaces inclined to each other at the same angle as between the adjacent ends of the surfaces defining the leading cutting edge.

A number of embodiments of the invention will now be described, by way of example only, with reference to the accompanying drawings, in which.

Figure 1:
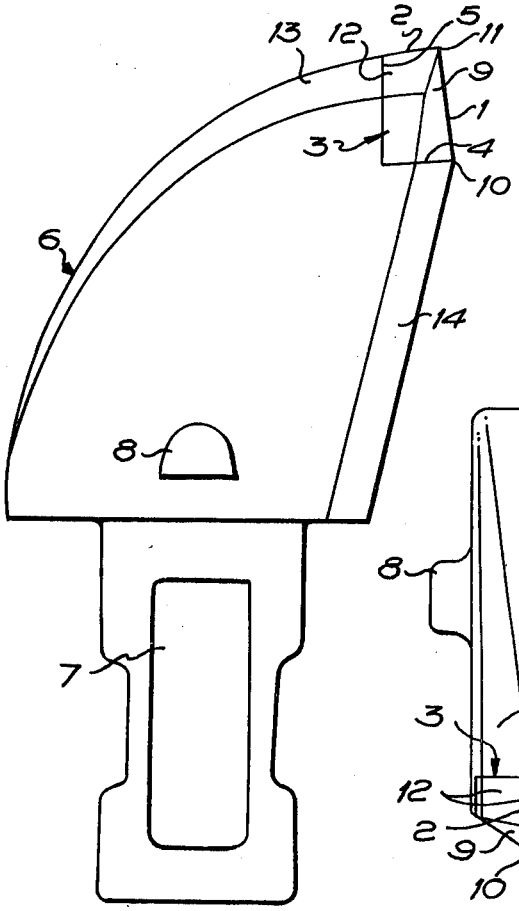
FIGS. 1, 2 and 3 are respectively side, front and end elevations of one embodiment of mineral cutting pick in accordance with the invention.
Figure 3:
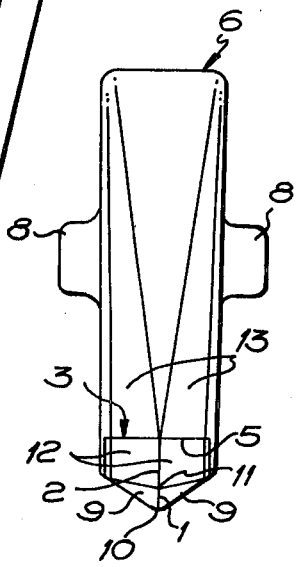
Figure 2:
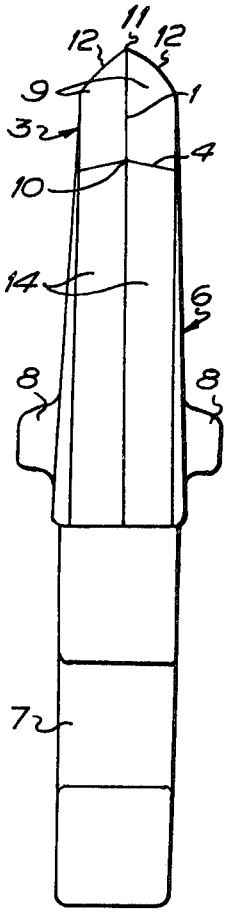
Figure 4:
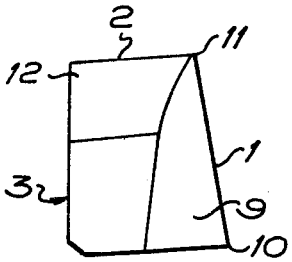
FIGS. 4 to 6 are corresponding enlarged elevations of the insert of the pick of FIGS. 1 to 3.
Figure 5:
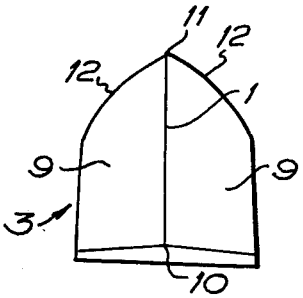
Figure 6:
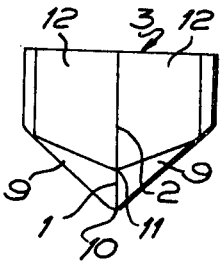

In FIGS. 1 to 3 a mineral cutting pick of the type adapted to be traversed relative to a mineral faces has a leading cutting edge 1 and an outer cutting edge 2 incorporated in a hard metal insert 3 (see also FIGS. 4 to 6) mounted in a rebate formed by a pair of seating surfaces 4, 5 at the end of a pick body 6 remote from a shank 7 for use in securing in a socket (not shown) of a chain or drum or the like, and the body has a pair of transverse projections 8 for use in extracting the pick from a socket by means of a two-pronged tool (not shown).

The leading cutting edge 1 has negative rake with respect to the shank 7, and the leading cutting edge is defined by surfaces 9 the angle between which increases from the position 10 at which it will make foremost contact with the mineral face to the end 11 of the leading cutting edge adjacent the outer cutting edge 2.

Thus a sharper angle for the leading cutting edge 1 is provided at 10 where it will attack the mineral face and a blunter angle is provided towards the end 11 adjacent the outer cutting edge 2 (i.e., towards the tip or nose of the insert) to afford greater strength as the insert decreases in transverse width towards the outer cutting edge.

The outer cutting edge 2 is defined by a pair of convexly curved surfaces 12, and the adjacent part of the pick body 6 is provided with surfaces 13 merging with the surfaces 12.

The part of the pick body 6 adjacent the leading cutting edge 1 is provided with surfaces 14 inclined to each other at the same angle as between the adjacent ends of the surfaces 9 defining the leading cutting edge.

Figure 7:
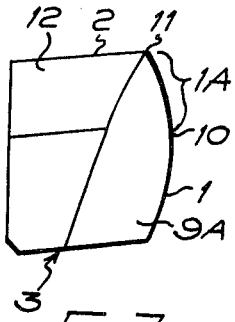
FIGS. 7 to 9, 10 to 12, 13 to 15, 16 to 18, 19 to 21, and 22 to 24 are sets of elevations corresponding to FIGS. 4 to 6 of alternative forms of inserts for mineral cutting picks in accordance with the invention.
Figure 8:
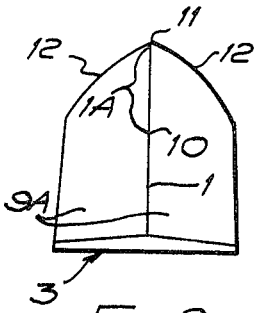
Figure 9:
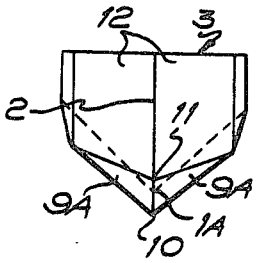
Figure 10:
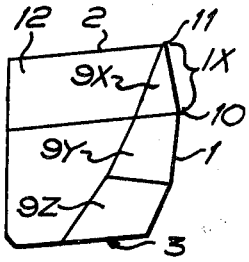
Figure 11:
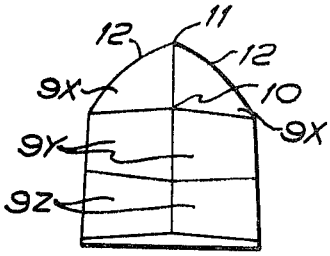
Figure 12:
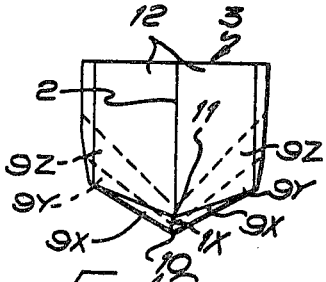

While the leading cutting edge 1 may be straight, as in FIGS. 1 to 6, it may alternatively be convexly curved, as in FIGS. 7 to 9, or it may be angular, as in FIGS. 10 to 12, with an appropriately shaped pair of surfaces 9A (FIGS. 7 to 9) or pairs of surfaces 9X, 9Y, 9Z (FIGS. 10 to 12) defining the leading cutting edge, and only a portion 1A or 1X of the leading cutting edge adjacent the outer cutting edge 2 has negative rake with respect to the shank 7 of a pick in which the insert is secured, the position 10 at which the leading cutting edge will make foremost contact with the mineral face will be appropriately nearer to the end 11 adjacent the outer cutting edge.

Figure 13:
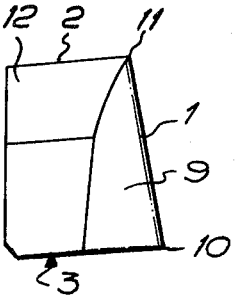
Figure 14:
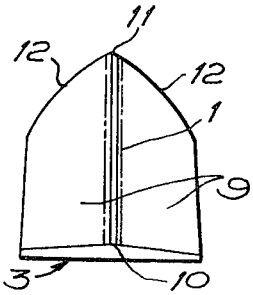
Figure 15:
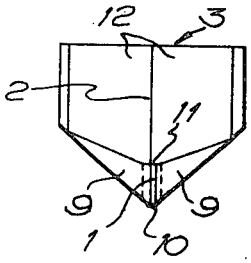
Figure 16:
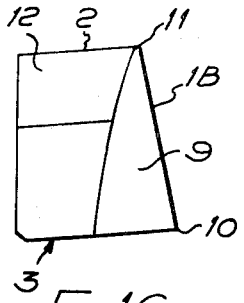
Figure 17:
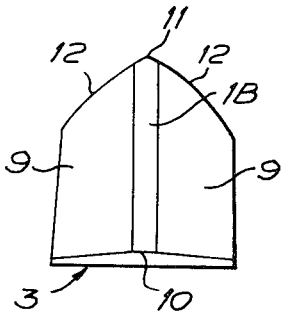
Figure 18:
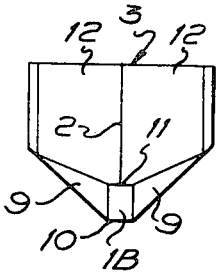
Figure 19:
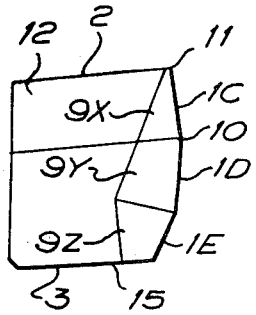
Figure 20:
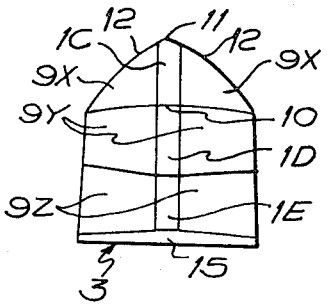
Figure 21:
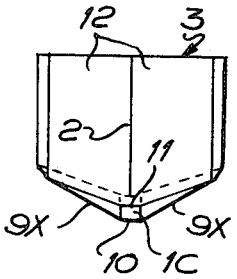

Again, while the leading cutting edge 1 may be a sharp edge, as in FIGS. 1 to 6, FIGS. 7 to 9 and FIGS. 10 to 12, it may alternatively be rounded, as in FIGS. 13 to 15, or it may be provided with a flat, such as 1B in FIGS. 16 to 18, or flats, such as 1C, 1D, 1E in FIGS. 19 to 21.

Figure 22:
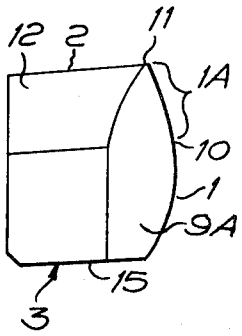
Figure 23:
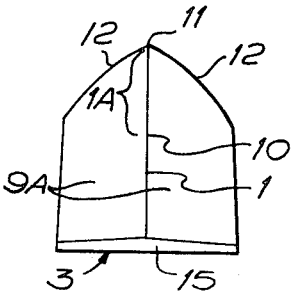
Figure 24:
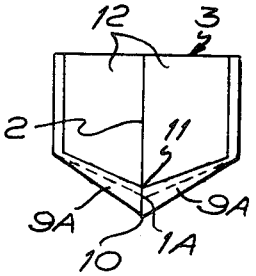

Although the insert of FIGS. 19 to 21 is very similar to the insert of FIGS. 10 to 12 in having pairs of surfaces 9X, 9Y, 9Z, apart from the flats 1C, 1D, 1E on the leading cutting edge, it also differs slightly in that the angle between the surfaces 9Z adjacent the surface 15 for mating with the rebate surface 4 on a pick body 6 is greater than the angle between the surfaces 9Z or the surfaces 9Y where these pairs of surfaces meet. Again, although the insert of FIGS. 22 to 24 is very similar to the insert of FIGS. 7 to 9, it differs slightly in that the angle between the surfaces 9A adjacent the surface 15 is greater than at the position 10 at which the leading cutting edge 1 will make foremost contact with the mineral face.

What I claim is:

1. A mineral cutting pick of the type adapted to be traversed relative to a mineral face and having a leading cutting edge and an outer cutting edge incorporated in a hard metal insert mounted in a rebate formed by a pair of seating surfaces at the end of a pick body remote from a shank for use in securing in a socket of a chain or drum or the like, at least one end of the leading cutting edge adjacent the outer cutting edge having negative rake with respect to the shank, and the leading cutting edge being defined by surfaces the angle between which increases from the position at which it will make foremost contact with the mineral face to the end of the leading cutting edge adjacent the outer cutting edge.

2. A mineral cutting pick as in claim 1, wherein the leading cutting edge is straight.

3. A mineral cutting pick as in claim 1, wherein the leading cutting edge is convexly curved.

4. A mineral cutting pick as in claim 1, wherein the leading cutting edge is angular.

5. A mineral cutting pick as in claim 1, wherein the leading edge is a sharp edge.

6. A mineral cutting pick as in claim 1, wherein the leading edge is rounded.

7. A mineral cutting pick as in claim 1, wherein the leading edge is provided with a flat or flats of transverse width small in relation to the overall width of the insert.

8. A mineral cutting pick as in claim 1, wherein the outer cutting edge is defined by a pair of convexly curved surfaces.

9. A mineral cutting pick as in claim 8, wherein the adjacent part of the pick body is provided with surfaces merging with the surfaces defining the outer cutting edge.

10. A mineral cutting pick as in claim 8, wherein the part of the pick body adjacent the leading cutting edge is provided with surfaces inclined to each other at the same angle as between the adjacent ends of the surfaces defining the leading cutting edge.

* * * * *